US007601111B2

(12) United States Patent
Sutherland et al.

(10) Patent No.: US 7,601,111 B2
(45) Date of Patent: Oct. 13, 2009

(54) GUSSETED CARTON

(75) Inventors: Robert L. Sutherland, Kennesaw, GA (US); Steve Ingram, Woodstock, GA (US)

(73) Assignee: Graphic Packaging International, Inc., Marietta, GA (US)

( * ) Notice: Subject to any disclaimer, the term of this patent is extended or adjusted under 35 U.S.C. 154(b) by 0 days.

(21) Appl. No.: 11/943,915

(22) Filed: Nov. 21, 2007

(65) Prior Publication Data

US 2008/0119344 A1 May 22, 2008

Related U.S. Application Data

(60) Provisional application No. 60/860,644, filed on Nov. 22, 2006.

(51) Int. Cl.
*B31B 1/00* (2006.01)

(52) U.S. Cl. ..... 493/68; 493/70; 493/79; 493/51

(58) Field of Classification Search ..... 493/68, 493/70, 79, 88, 51, 59, 63, 162
See application file for complete search history.

(56) References Cited

U.S. PATENT DOCUMENTS

| | | | | |
|---|---|---|---|---|
| 2,810,506 | A | | 10/1957 | Kessler |
| 2,868,433 | A | | 1/1959 | Anderson, Jr. |
| 2,955,739 | A | | 10/1960 | Collura |
| 3,112,856 | A | | 12/1963 | MacIntosh et al. |
| 4,036,423 | A | | 7/1977 | Gordon |
| 4,328,923 | A | | 5/1982 | Graser |
| 4,378,905 | A | | 4/1983 | Roccaforte |
| 4,498,619 | A | | 2/1985 | Roccaforte |
| 4,546,914 | A | | 10/1985 | Roccaforte |
| 4,588,084 | A | | 5/1986 | Holley, Jr. |
| 5,020,337 | A | | 6/1991 | Krieg |
| 5,292,058 | A | | 3/1994 | Zoss et al. |
| 5,472,090 | A | * | 12/1995 | Sutherland ..... 206/427 |
| 5,495,727 | A | | 3/1996 | Strong et al. |
| 5,551,566 | A | | 9/1996 | Sutherland |
| 5,582,343 | A | | 12/1996 | Dalvey |
| 5,639,017 | A | | 6/1997 | Fogle |
| 5,794,778 | A | | 8/1998 | Harris |
| 5,873,515 | A | | 2/1999 | Dunn et al. |
| 5,915,546 | A | | 6/1999 | Harrelson |
| 5,992,733 | A | | 11/1999 | Gomes |
| 6,021,897 | A | * | 2/2000 | Sutherland ..... 206/427 |
| 6,065,590 | A | | 5/2000 | Spivey |

(Continued)

FOREIGN PATENT DOCUMENTS

DE 20 2004 018 649 U1 4/2005

(Continued)

*Primary Examiner*—Sameh H. Tawfik
(74) *Attorney, Agent, or Firm*—Womble Carlyle Sandridge & Rice, PLLC

(57) ABSTRACT

A carton includes a bottom receptacle defined in part by the bottom panel, the side panels, and gusseted end panels. The bottom receptacle can be constructed without glue seals so that the receptacle is liquid-tight. An opening feature in the top panel allows the carton to be opened and to expose the carton contents. The carton is formed from a blank that is folded and glued in a manner that facilitates loading of the carton, and allows the carton to be opened to a relatively wide top opening.

23 Claims, 15 Drawing Sheets

U.S. PATENT DOCUMENTS

| | | | | |
|---|---|---|---|---|
| 6,112,977 | A * | 9/2000 | Sutherland et al. | 229/117.13 |
| 6,164,526 | A | 12/2000 | Dalvey | |
| 6,834,793 | B2 * | 12/2004 | Sutherland | 229/227 |
| 6,869,009 | B2 * | 3/2005 | Sutherland et al. | 229/121 |
| 6,926,193 | B2 | 8/2005 | Smalley | |
| 7,380,701 | B2 * | 6/2008 | Fogle et al. | 229/103.2 |
| 7,416,109 | B2 * | 8/2008 | Sutherland | 229/227 |
| 2006/0273143 | A1 | 12/2006 | Finch | |
| 2007/0051781 | A1 | 3/2007 | Holley, Jr. | |
| 2007/0181658 | A1 | 8/2007 | Sutherland | |
| 2007/0284424 | A1 | 12/2007 | Holley | |

FOREIGN PATENT DOCUMENTS

| | | | |
|---|---|---|---|
| EP | 0 412 226 | A1 | 2/1991 |
| FR | 1 494 239 | | 9/1967 |
| FR | 2 579 175 | | 9/1986 |
| WO | WO 2007/089282 | | 8/2007 |

* cited by examiner

GUSSETED CARTON

PRIORITY APPLICATION

This application claims the benefit of Provisional Application No. 60/860,644, filed Nov. 22, 2006, the entire contents of which are hereby incorporated by reference.

RELATED ART

Dispensing cartons are known. Conventional dispensing cartons may have a top panel with a dispensing feature formed therein. Such cartons may be used to contain articles such as beverage containers that are dispensable through the top panel or through another panel when the carton is opened.

SUMMARY

According to one embodiment, a carton is erected from a blank comprising a first side panel, a bottom panel, a second side panel foldably connected to the bottom panel at a transverse fold line, a first top panel, a second top panel, a first bottom end panel at a first end of the bottom panel, a second bottom end panel at a second end of the bottom panel, at least one first top flap foldably connected to a first end of the first top panel at a first longitudinal fold line, and at least one second top flap foldably connected to a second end of the first top panel at a second longitudinal fold line. The carton may be folded and glued so that when opened, the carton has a relatively wide top opening.

Other aspects, features, and details of the present invention can be more completely understood by reference to the following detailed description, taken in conjunction with the drawings and from the appended claims.

BRIEF DESCRIPTION OF THE DRAWING FIGURES

According to common practice, the various features of the drawings discussed below are not necessarily drawn to scale. Dimensions of various features and elements in the drawings may be expanded or reduced to more clearly illustrate the embodiments of the invention.

DETAILED DESCRIPTION

The present invention generally relates to cartons suitable for storing and dispensing articles such as, for example, beverage containers, and methods of erecting such cartons.

Articles accommodated within the present carton embodiments can include containers such as, for example, petaloid bottle containers, beverage cans, glass or plastic bottles, or other containers such as, for example, those used in packaging foodstuffs. For the purposes of illustration and not for the purpose of limiting the scope of the invention, the following detailed description describes generally cylindrical beverage containers as disposed within the carton. In this specification, the terms "end," "side," "bottom," and "top" indicate orientations determined in relation to fully erected, upright cartons. These directional terms are not intended to limit the invention, but are instead used to distinguish carton panels.

Figure 1:
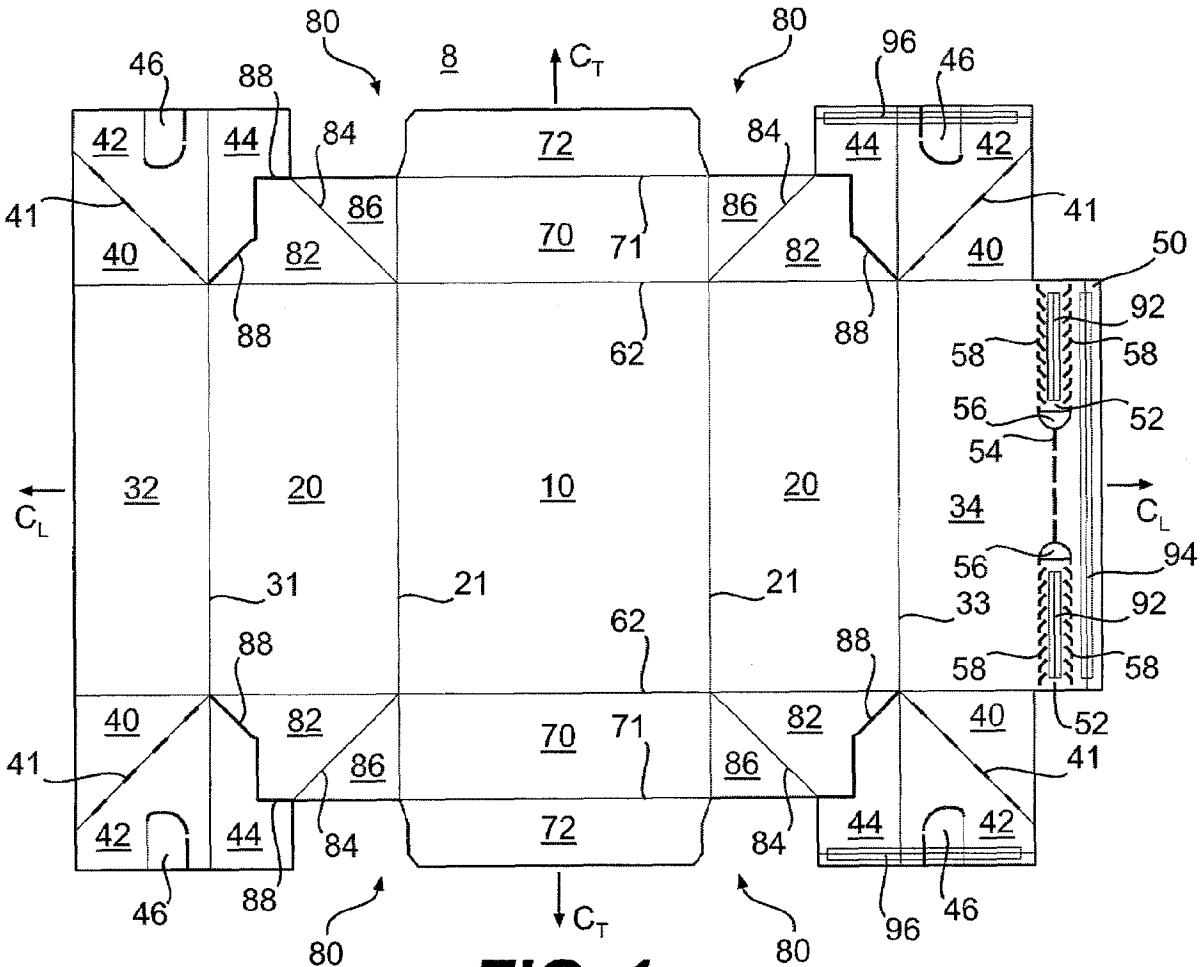
FIG. 1 is a plan view of a blank used to form a carton according to a first embodiment of the invention.

FIG. 1 is a plan view of a blank 8 used to form a carton 160 (illustrated in FIG. 12) according to the first embodiment of the invention. The exterior, upper or "print" surface of the blank 8 is visible in FIG. 1. As shown in FIG. 1, the blank 8 may be symmetric or nearly symmetric about a transverse centerline $C_T$ and a longitudinal centerline $C_L$. Therefore, certain elements in the drawing figures may be indicated by identical or similar reference numerals in order to reflect the partial or complete symmetries in the blank 8.

The blank 8 comprises a bottom panel 10, first and second side panels 20 foldably connected to each side of the bottom panel 10 at transverse fold lines 21, a first top panel 32 foldably connected to the first side panel 20 at a transverse fold line 31, and a second top panel 34 foldably connected to the second side panel 20 at a transverse fold line 33.

A first top flap 40 is foldably connected to each end of the first top panel 32, and foldably connected to each end of the second top panel 34. The first top flaps 40 are foldably connected at longitudinal fold lines 62. Each first top flap 40 is connected to a second top flap 42 at an oblique fold line 41. Each second top flap 42 is foldably connected to a top end flap 44. The second top flaps 42 include handle features 46 extending to exterior edges of the flaps 42.

A bottom end panel 70 is foldably connected to each end of the bottom panel 10 at a respective longitudinal fold line 62. Each bottom end panel 70 can include a distal section 72 defined at an interior edge by a longitudinal crease or fold line 71.

A gusset 80 is located at each corner of the bottom panel 10. Each gusset 80 comprises a gusset panel pair including a first gusset panel 82 foldably connected to one side of a side panel 20 at a longitudinal fold line 62, and a second gusset panel 86 foldably connected to the first gusset panel 82 at an oblique fold line 84, and also foldably connected to one side of a bottom end flap 70 at a transverse fold line 21. The first gusset panels 82 are separated from adjacent top end flaps 44 by cuts 88.

The second top panel 34 includes an adhesive section 50 defined in part in the panel 34 by a breachable or frangible transverse line 54 and by spaced transverse tear strips 52 at each end of the frangible line 54. The tear strips 52 can include finger access features, such as apertures 56. The breach line 54 and the tear strips 52 facilitate opening of the erected carton 160, as discussed in further detail below. The breach line 54 may be, for example, a tear line, or other breachable line of disruption. The tear strips 52 can be defined by, for example, spaced tear lines 58. Adhesive 94 is applied to the exterior or print surface of the adhesive section 50, and adhesive 92 is applied to the print sides of the tear strips 52. Adhesive 96 is applied to the print sides of the flaps 42, 44 connected to the second side panel 34 at the second side of the blank 8.

An exemplary method of erection of the blank 8 into the carton 160 and loading of the carton will now be discussed with reference to FIGS. 2-11.

Figure 2:
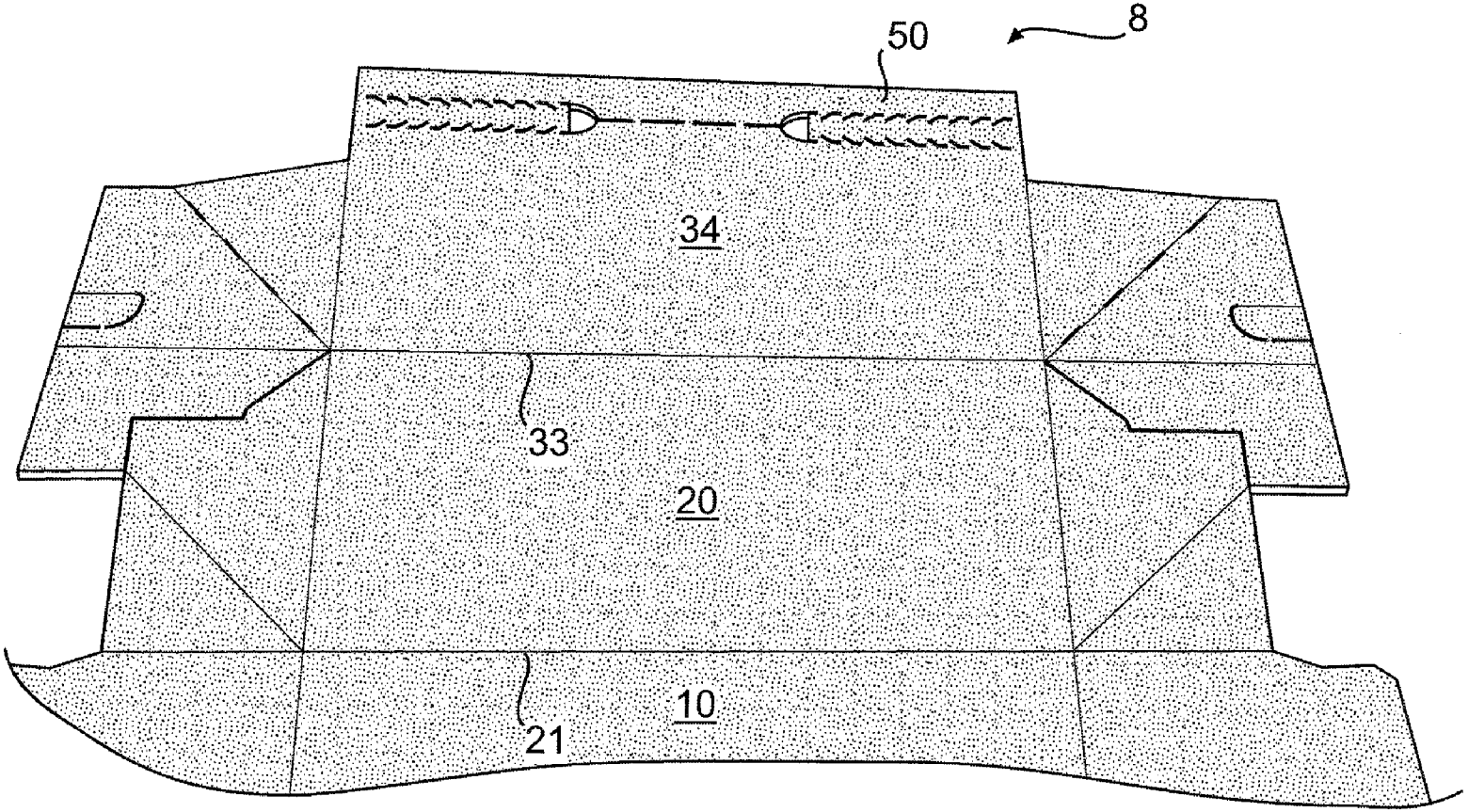
FIGS. 2-11 illustrate erection steps of the carton from the blank of FIG. 1.
Figure 3:
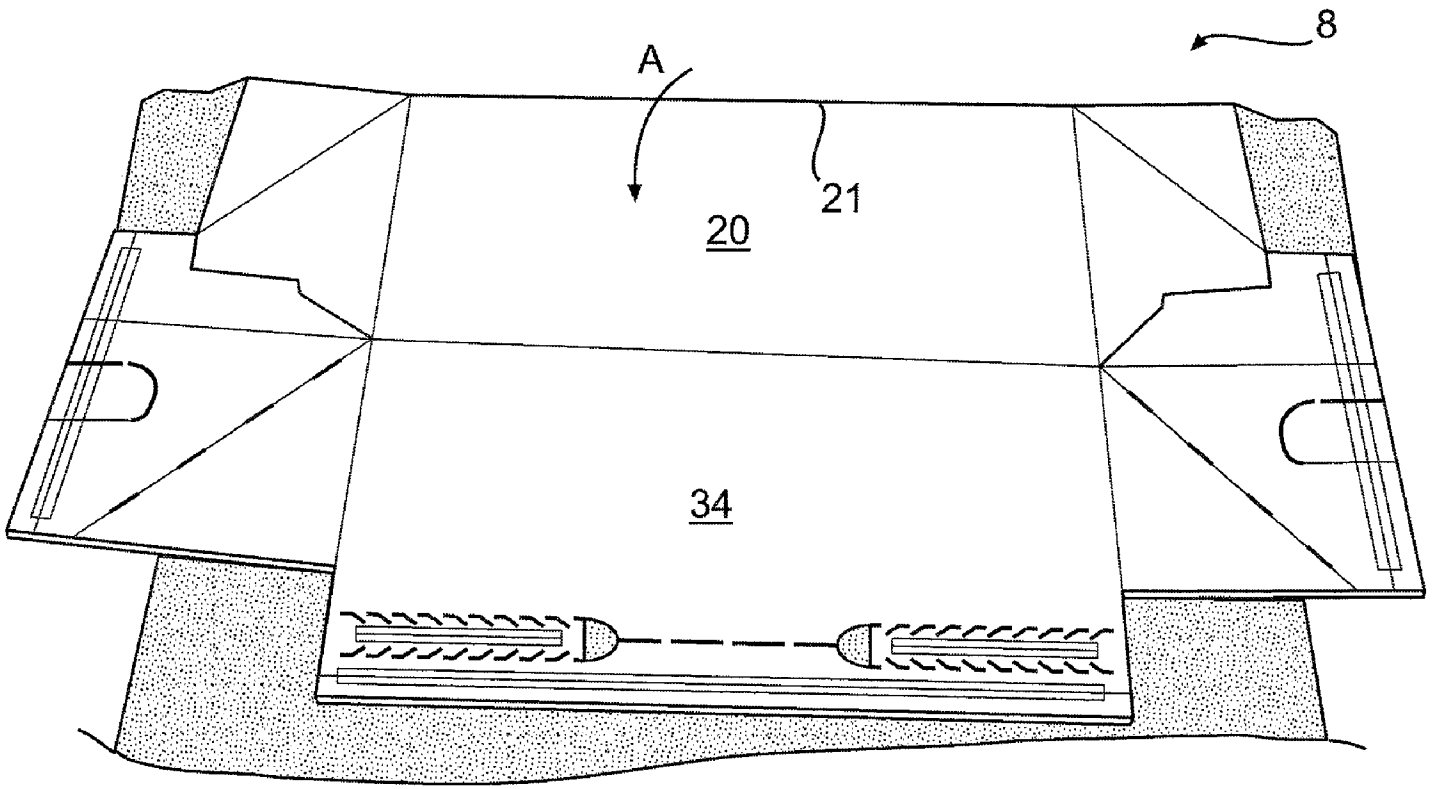

FIG. 2 illustrates a second side (i.e., the side of the blank 8 to the right in FIG. 1) of the blank 8. In FIG. 2, the blank 8 is print or exterior side down, with the underside of the blank shaded with stippling. In the drawing figures, the underside of the blank 8 is stippled to distinguish the underside of the blank from the exterior or print side. FIG. 3 illustrates an initial erection step in which the blank 8 is folded about the transverse fold line 21 in the direction of the arrow A so that the second side panel 20 and the second top panel 34 are print side up.

Figure 4:
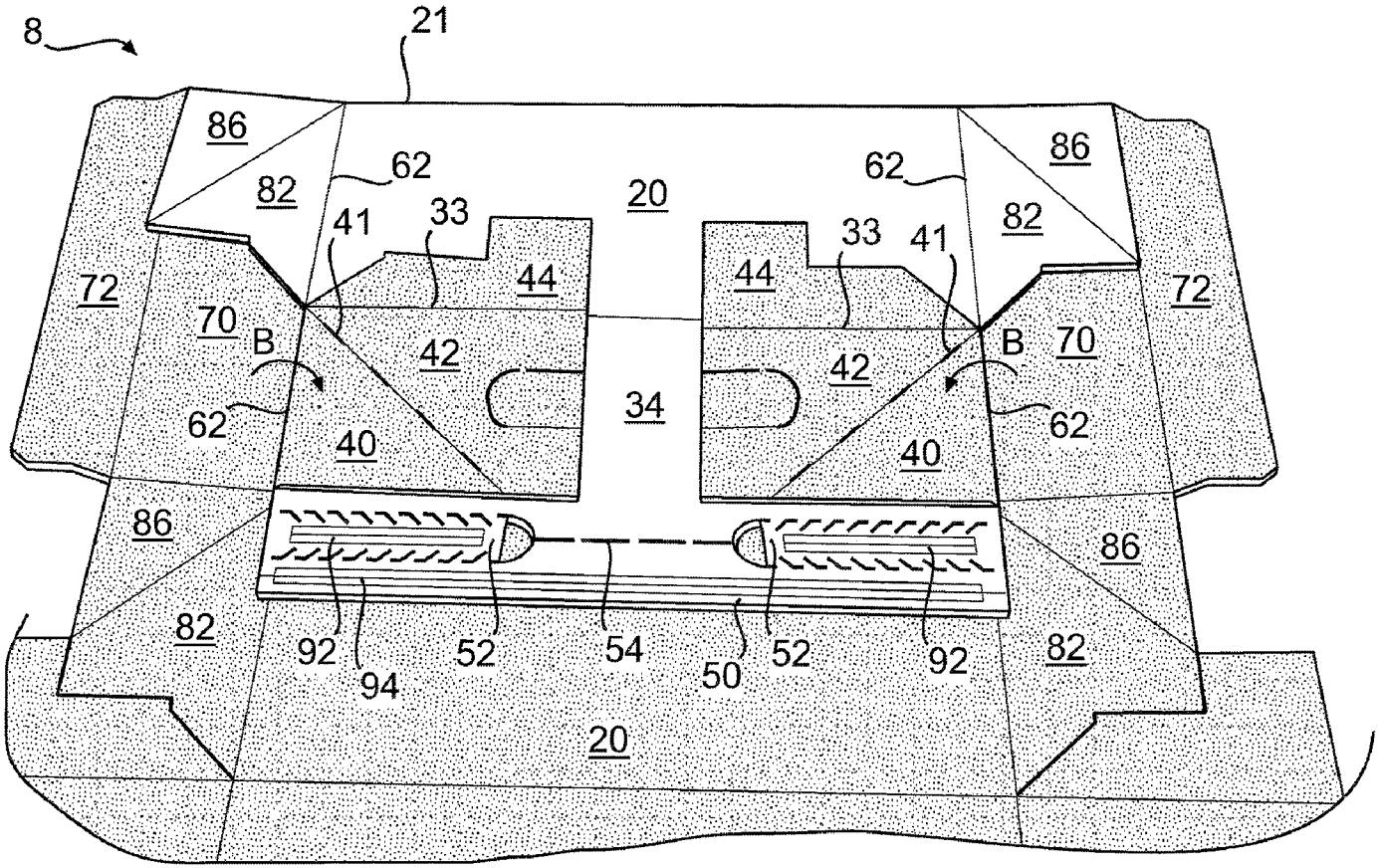

Referring to FIG. 4, the blank 8 is folded about both longitudinal fold lines 62 at the edges of the second top panel 34 in the direction of the arrows B so that the first top flaps 40, the second top flaps 42 and the top end flaps 44 connected to the second top panel 34 are print side down.

Figure 5:
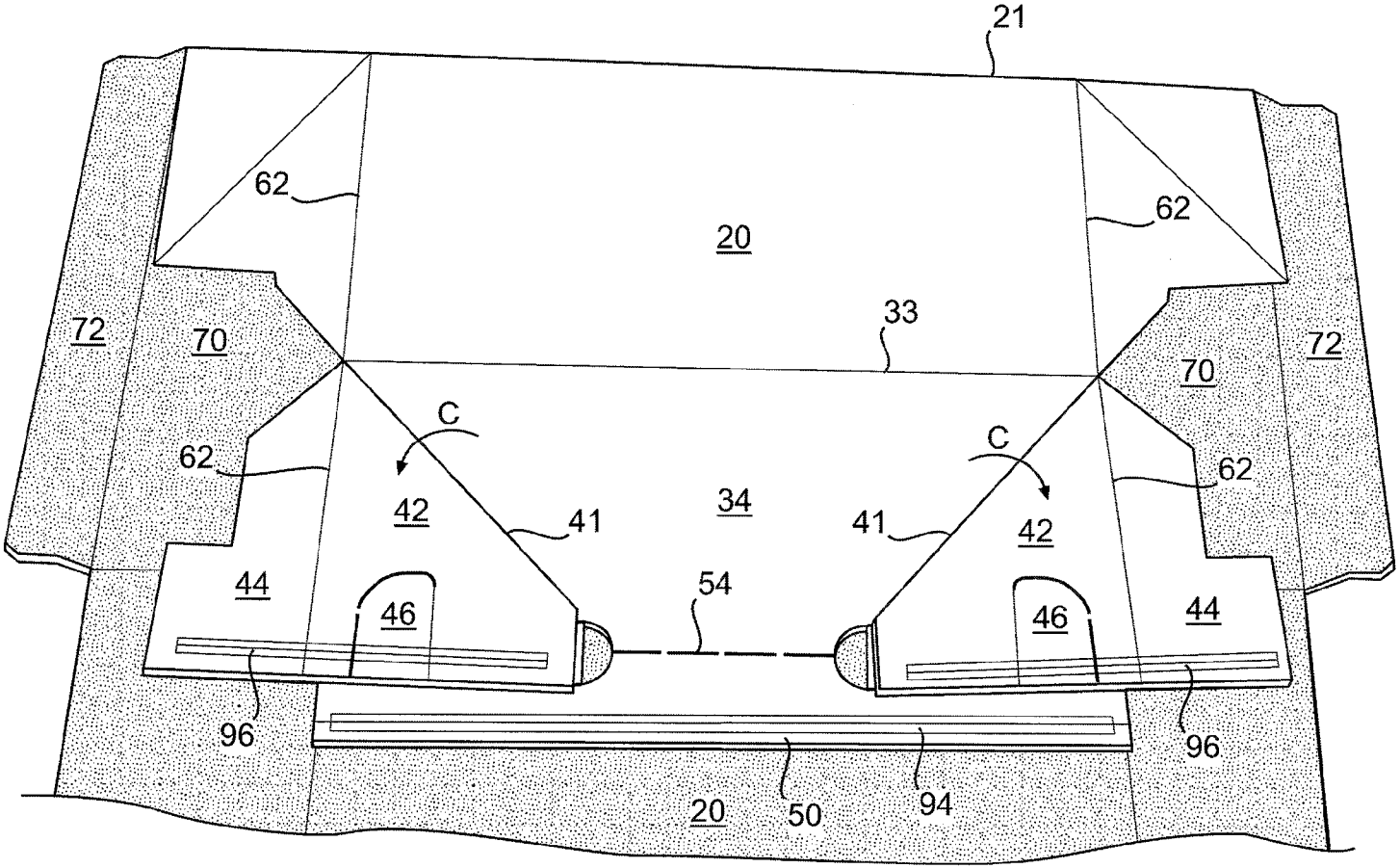

Referring to FIG. 5, the second top flaps 42 and the top end flaps 44 are folded over about the oblique fold lines 41 in the direction of the arrows C so that the second top flaps 42 overlap their adjacent first top flaps 40 (the top flaps 40 are not visible in FIG. 5). The undersides of the top flaps 42 are adhered to the print sides of adjacent tear strips 52 by the adhesive 92 (shown in FIG. 4).

Figure 6:
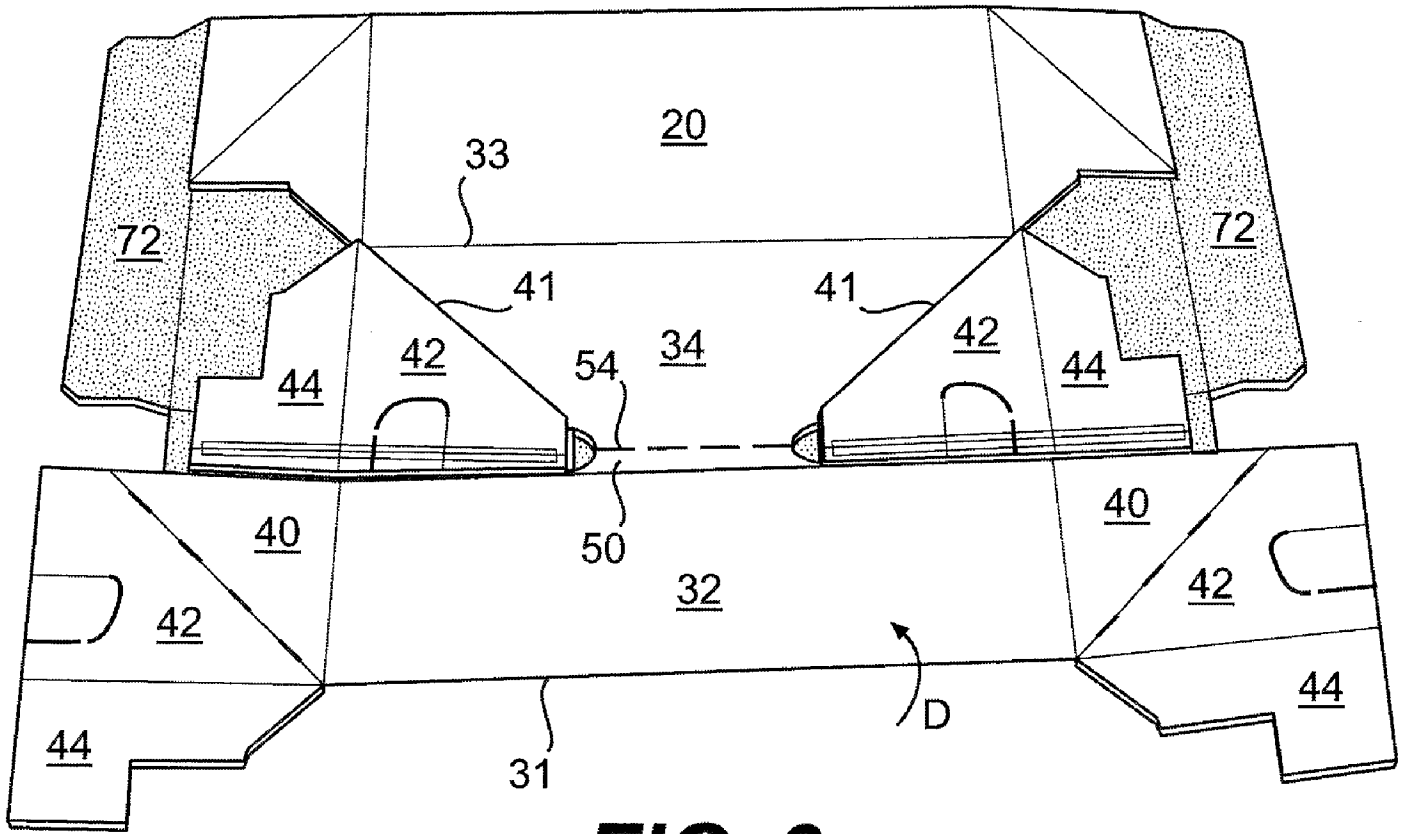

Referring to FIG. 6, the first top panel 32 and the flaps 40, 42, 44 attached thereto are folded over about the transverse fold line 31 in the direction of the arrow D. The underside of the first top panel 32 is brought into contact with and adhered to the adhesive section 50 of the second top panel 34 by the adhesive 94 (shown in FIG. 5).

Figure 7:
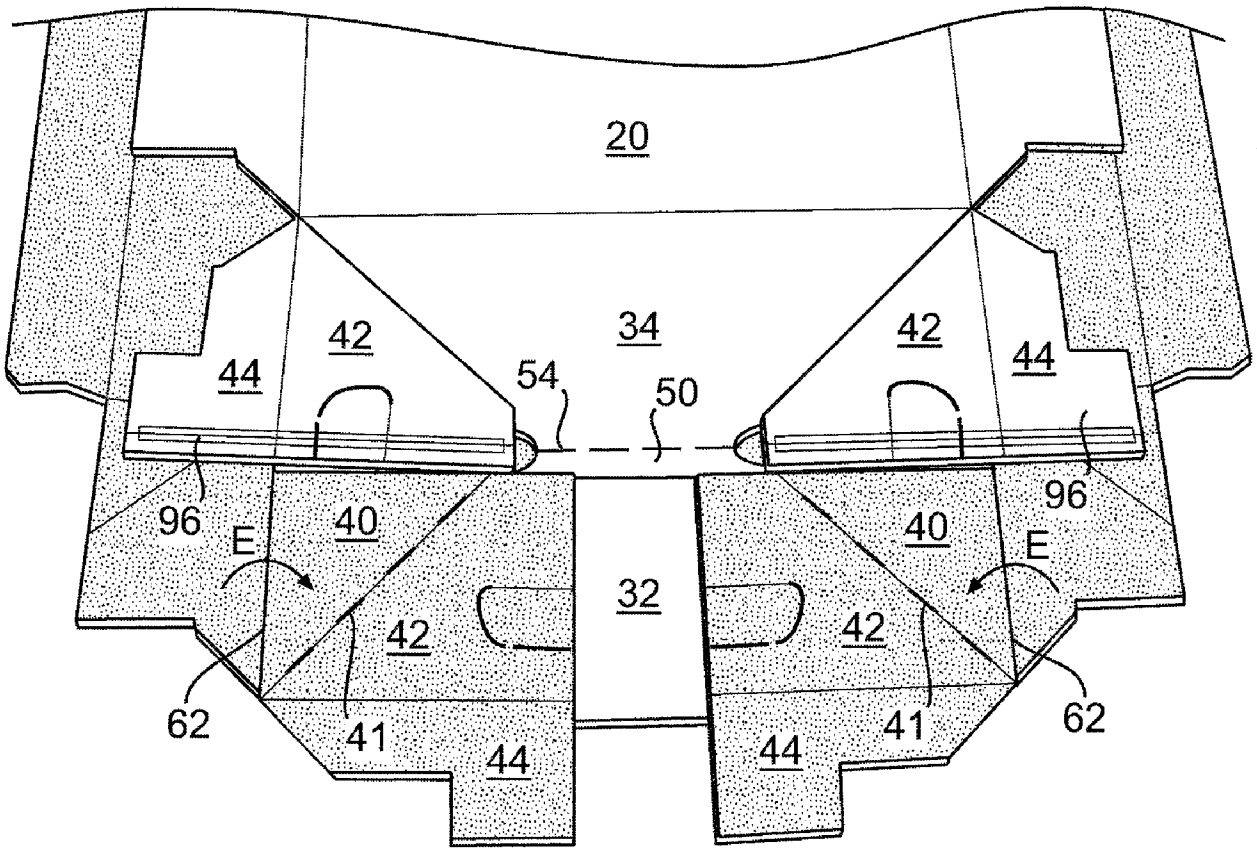

Referring to FIG. 7, the blank 8 is folded about the longitudinal fold lines 62 at the edges of the first top panel 32 in the direction of the arrows E so that the first top flaps 40, the second top flaps 42 and the top end flaps 44 connected to the first top panel 32 are print side down.

Figure 8:
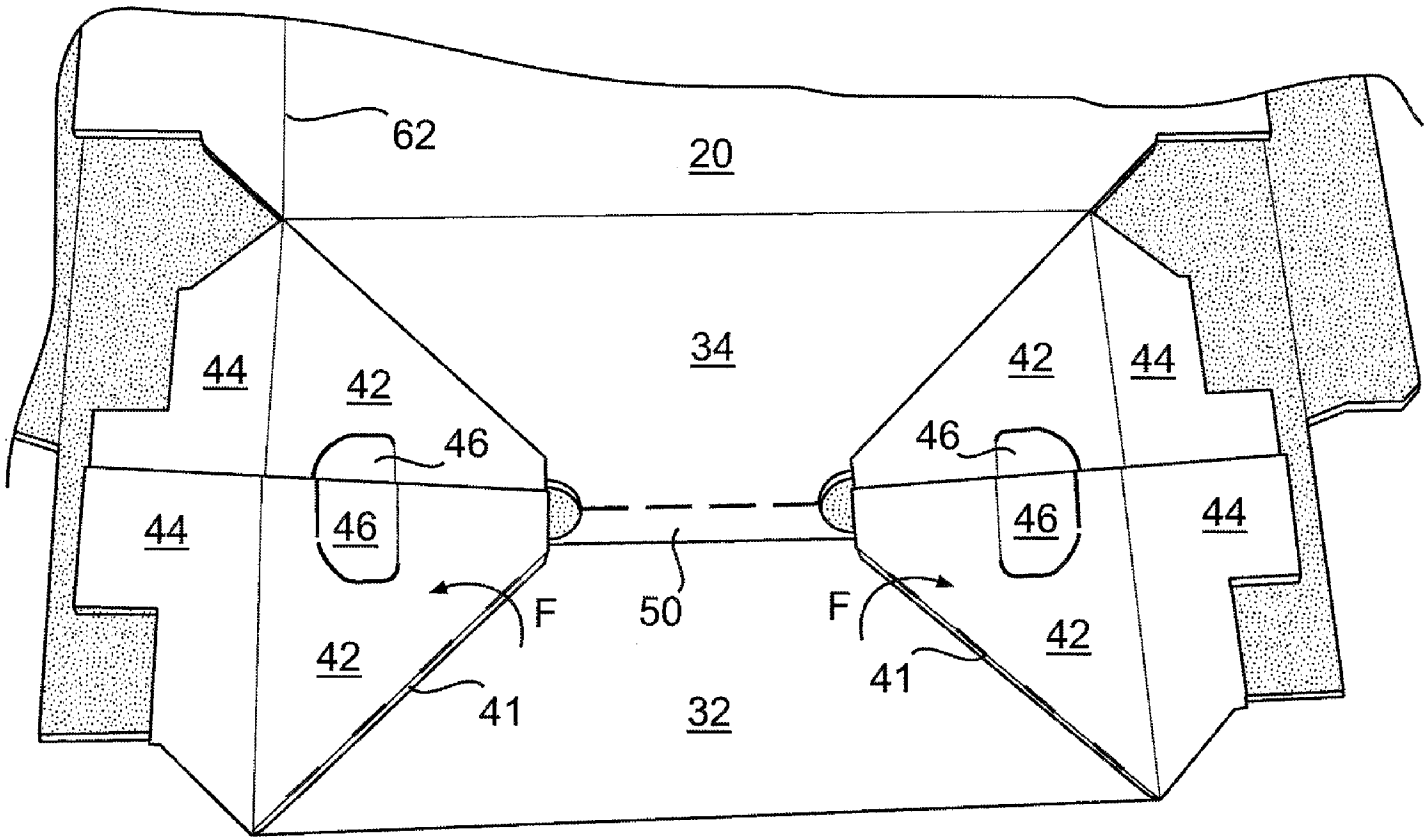

Referring to FIG. 8, the second top flaps 42 and the top end flaps 44 at the first side of the blank 8 (i.e., the side of the blank to the left in FIG. 1) are folded about the oblique fold lines 41 in the direction of the arrows F so that the second top flaps 42 overlap the foldably connected first top flaps 40. The flaps 42, 44 are now print side up. The undersides of the top flaps 42 at the first side panel 32 side of the blank 8 are adhered to the adhesive 96 (shown in FIG. 7) extending across the top flaps 42 at the second side of the blank 8. The undersides of the top end flaps 44 at the first side of the blank 8 are also adhered by the adhesive 96 to the top end flaps 44 at the second side of the blank 8. The handle features 46 in the overlapped second top flaps 42 are aligned with one another and adhered together by the adhesive 96.

Figure 9:
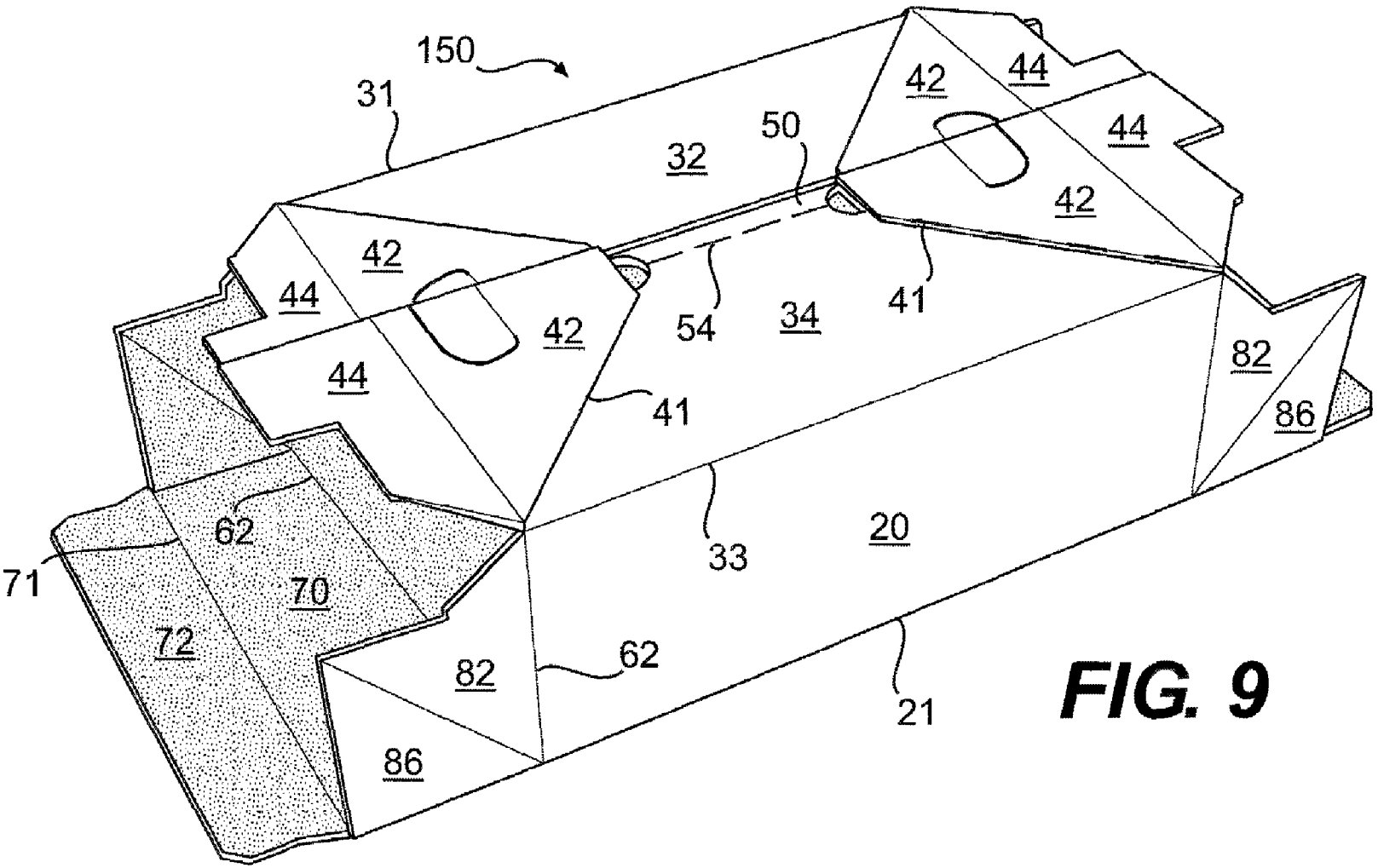

Referring to FIG. 9, the partially erected blank may be opened up to a structure have a generally tubular configuration with open ends. The overlapping top panels 32, 34 and the panels 40, 42 form a top panel 150.

Figure 10:
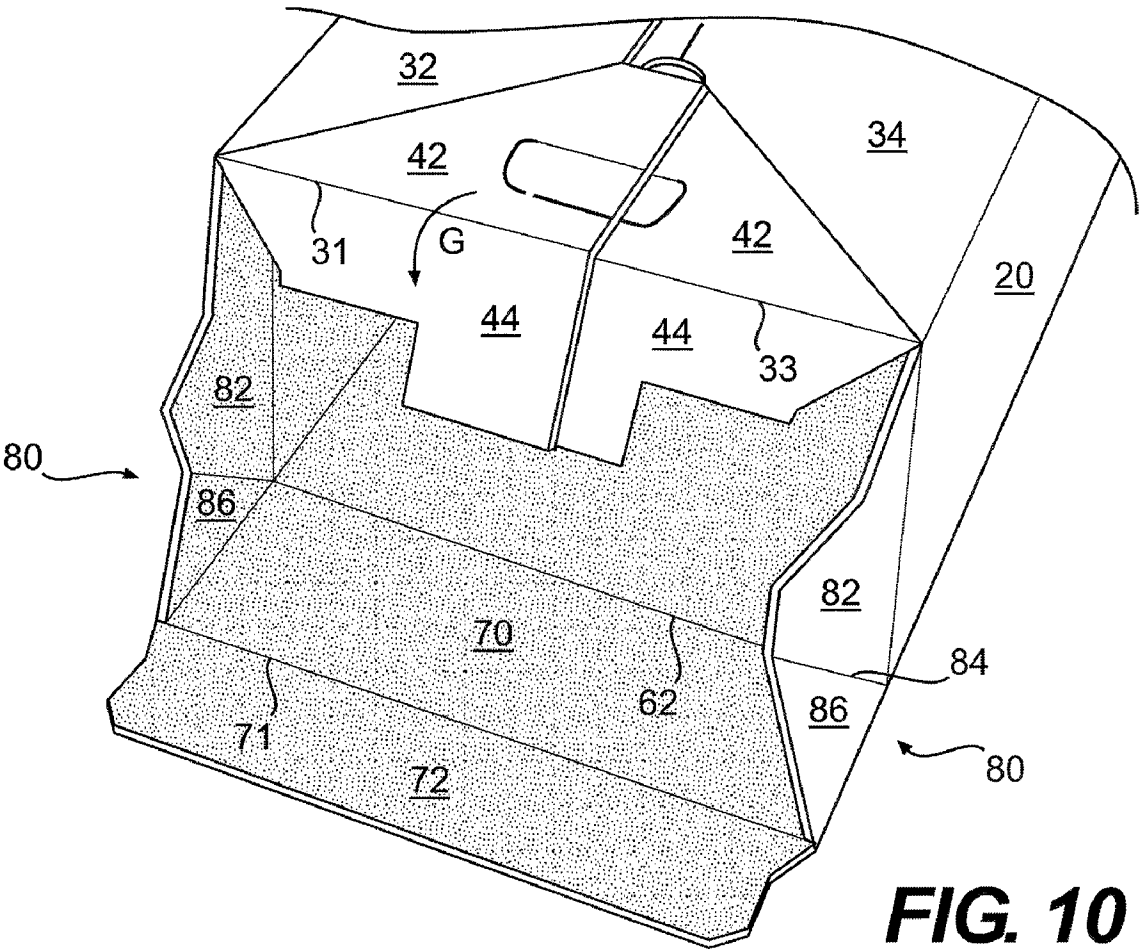
Figure 11:
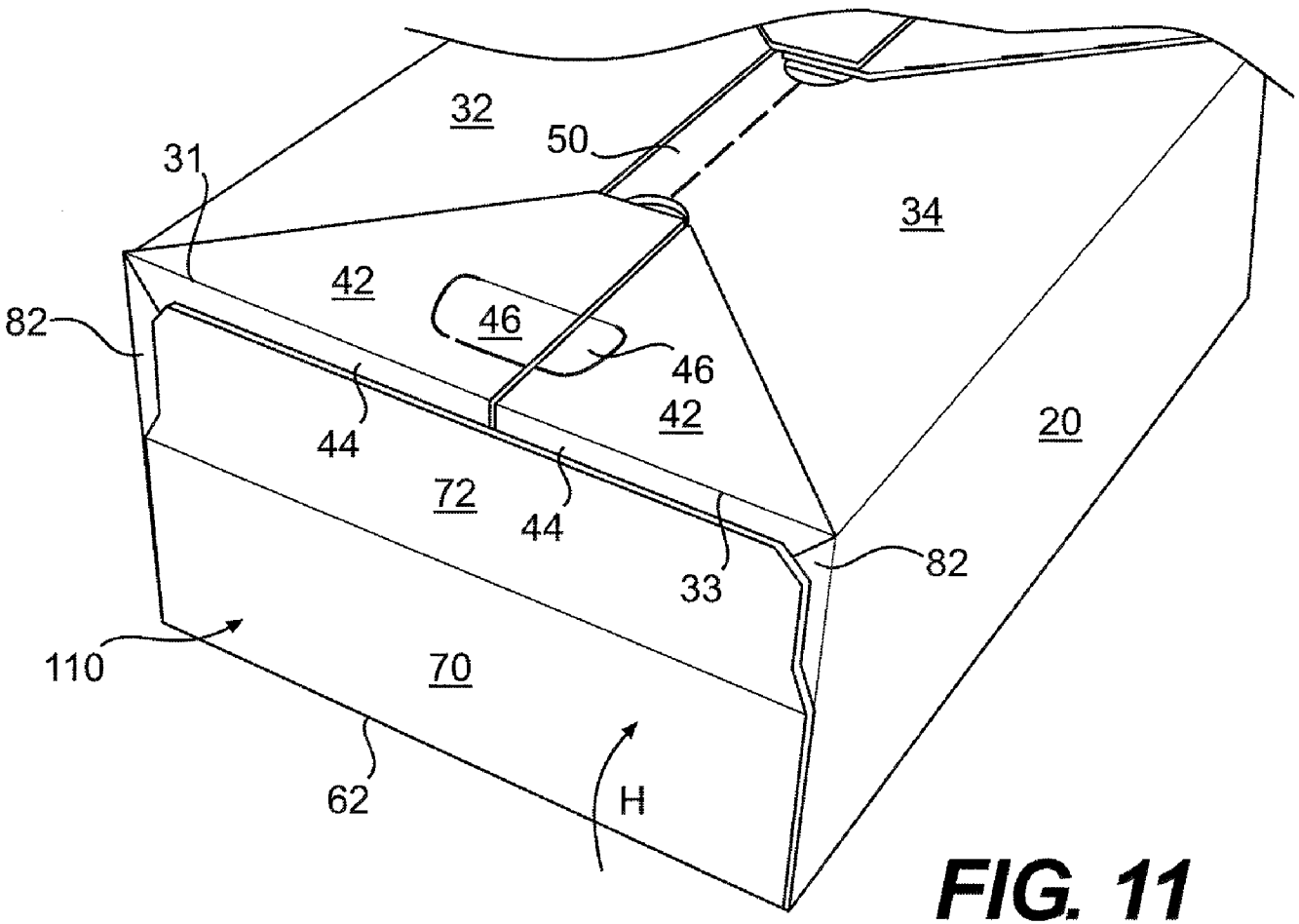

FIGS. 10 and 11 illustrate closure of one end of the carton. The opposite end can be closed in substantially the same manner. Referring to FIG. 10, the top end flaps 44 are folded down over the open end of the carton at the fold lines 31, 33 in the direction of the arrow G. Referring also to FIG. 11, the gussets 80 are folded inwardly about the oblique fold lines 84. As the gussets 80 are folded inwardly, the bottom end flap 70 (shown in FIG. 9) folds about the longitudinal fold line 62 and moves upwardly in the direction of the arrow H toward the top end flaps 44. Glue or other adhesives (not illustrated) may be applied to the interior or underside of the bottom end panels 70 at the distal sections 72. The interior side of the distal section 72 may be pressed against and adhered to the print side of the top end flaps 44. Either of the gusset panels 82, 86 may be, for example, adhered together or adhered to the bottom end flap 70. The flaps 44, 70 and the panels 82, 86 form an end panel 110 at each end of the carton.

Figure 12:
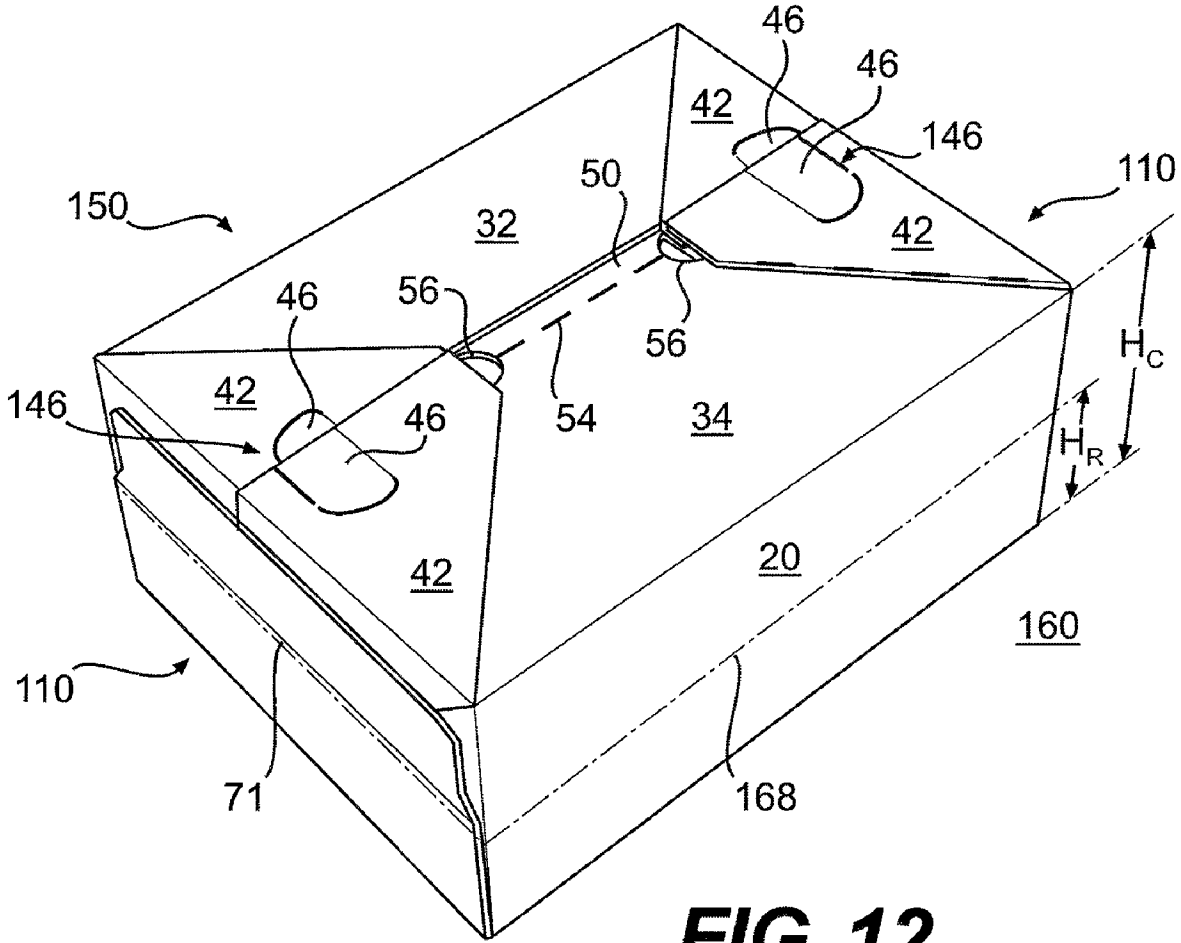
FIG. 12 illustrates the erected carton with containers accommodated therein.

FIG. 12 illustrates the erected carton 160. The partially overlapping and adhered handle features 46 at each end of the carton 160 form handles 146. The carton 160 may be loaded with articles at any time before fully closing the carton 160. In the illustrated embodiment, the carton 160 is loaded with twelve generally cylindrical twelve-ounce beverage containers C (illustrated in FIG. 14) disposed in a 3×4×1 configuration. The erected carton 160 is substantially parallelepipedal.

Figure 13:
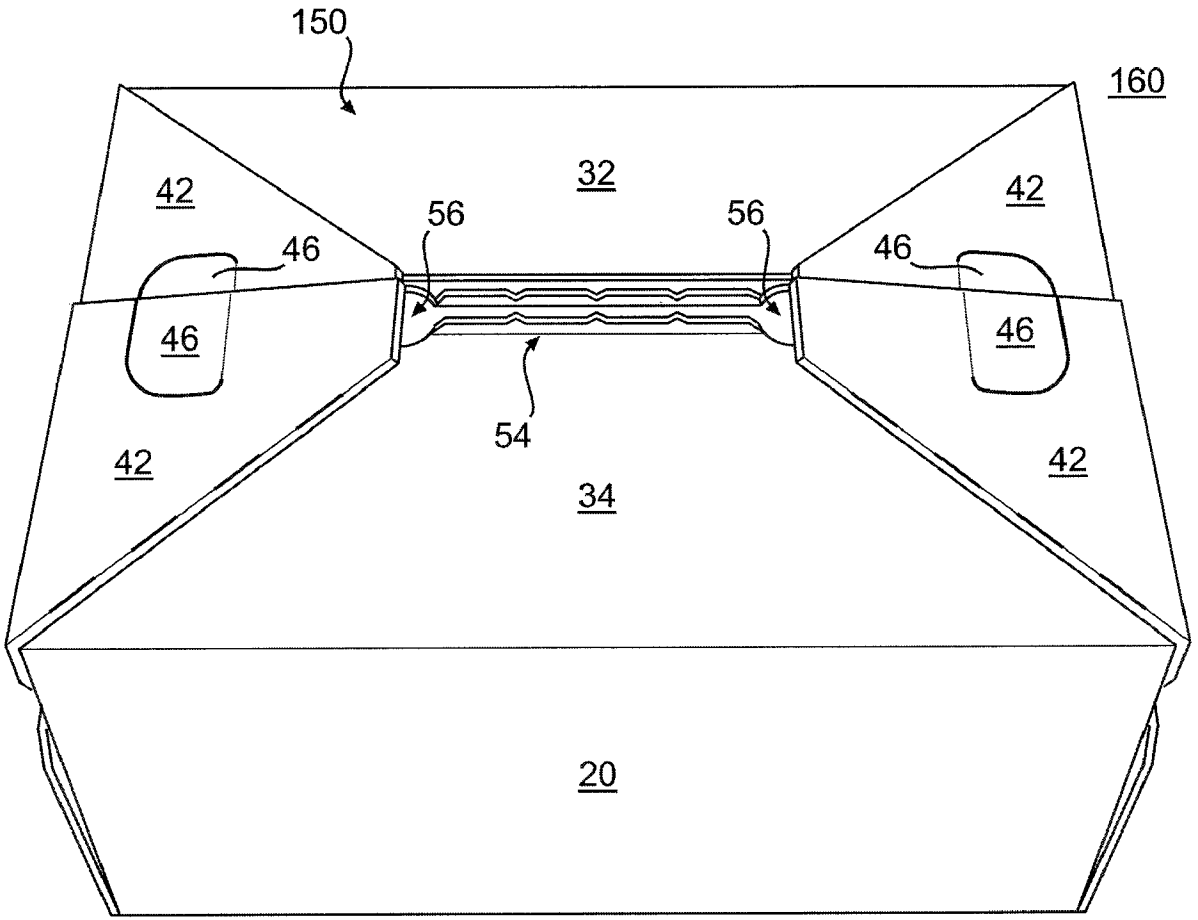
FIG. 13 illustrates an opening step of the carton.

FIG. 13 illustrates an opening step of the carton 160. The carton 160 may be opened by breaching the top panel 150 at the breach line 54 (illustrated in FIG. 12). The breach line 54 may be breached, for example, by the user pressing a hand or finger, etc. through the top panel 150 at the breach line 54. The overlapped second top flaps 42 and first top flaps 40 (not visible in FIG. 13) may then be pulled outwardly and upwardly. Alternatively, the overlapped flaps 40, 42 may be pulled outwardly by accessing the flaps at the access features 56 and tearing the top panel 150 at the breach line 54.

Figure 14:
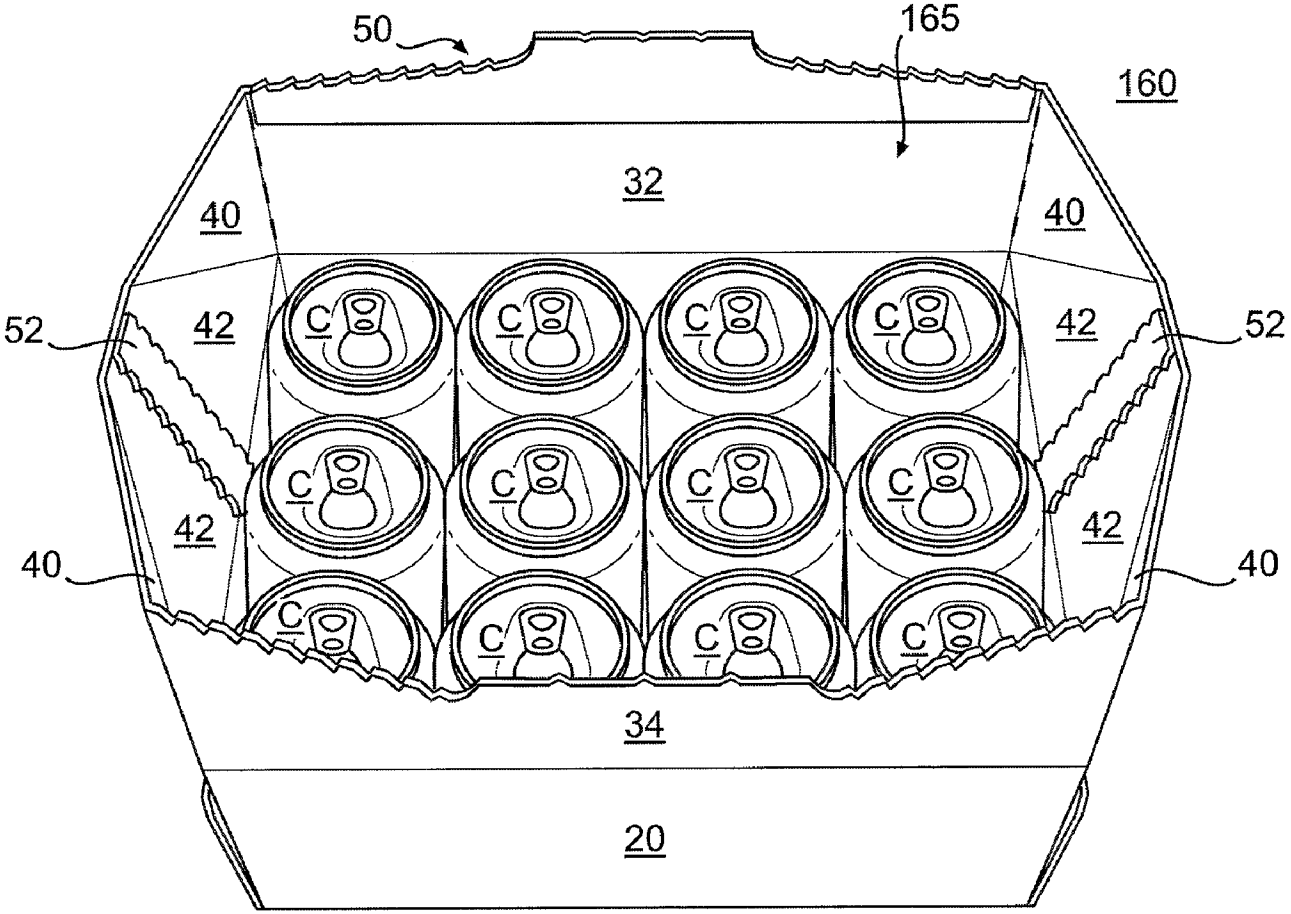
FIGS. 14 and 15 illustrate the opened carton.
Figure 15:
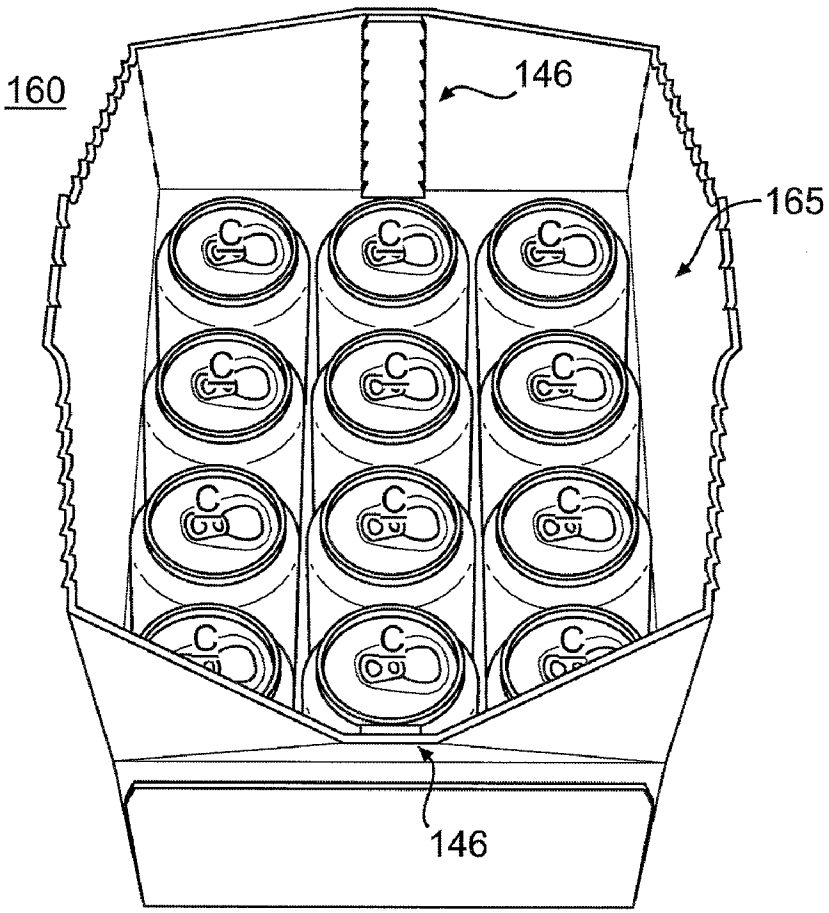

Referring to FIG. 14, and also to FIGS. 4 and 5, each tear strip 52 is adhered to an overlapping second top flap 42 at the second side of the carton blank. Pulling the flaps 40, 42 as shown in FIG. 13 causes the tear strips 52 to separate from the second top panel 34, while the tear strips 52 remain adhered to the overlapping second top flaps 42. The adhesive section 50 of the second top panel 34 is separated from the second top panel 34 and remains adhesively attached to the first top panel 32. FIG. 15 is a another illustration of the opened carton 160. The carton 160 may be carried by the handles 146 at each end of the carton. Ice, cool water, or other coolant means, for example, may then be introduced into the interior of the carton 160 so that it contacts the containers C.

As shown in FIG. 14, the carton 160 can be opened to have a relatively wide top opening. This feature allows for easy access to the containers C in the carton 160.

Referring to FIGS. 12, 14 and 15, the gussets 80 may define in part an at least partially liquid-tight bottom receptacle 165 in the erected carton 160. The top edge or upper border of the bottom receptacle 165 is indicated by red dashed perimeter 168 in FIG. 12, and represents a portion of the bottom of the carton 160 below which no glued seals or seams are formed through which water or other liquid might leak. That is, no adhesive seal or other joinder of material where fluid might escape the carton 160 is located in the carton at a position below the top edge of the bottom receptacle 165. The bottom receptacle 165 may therefore be formed from a continuous section of folded material of the blank 8. The height of the liquid-tight portion of the receptacle 165 below which there are no glued seams is generally indicated as a height $H_R$ in FIG. 12. The height $H_R$ of the perimeter 168 may correspond to, for example, the height of the fold line 71 shown in FIG. 12. The height $H_R$ may be, for example, defined as a function of a height of the carton 160. For example, the bottom receptacle 165 may define a liquid-tight portion having a height $H_R$ that is at least about 10% of a height $H_C$ of the carton 160. In another embodiment, the receptacle 165 height $H_R$ may be at least about 20% of a height $H_C$ of the carton 160. The receptacle height $H_R$ may be increased or decreased, for example, to accommodate larger or smaller anticipated liquid volumes in the carton 160.

If desired, additional articles may be placed in the carton 160 after opening. For example, if the containers C are beverage containers, ice may be placed over the containers C and held within the carton interior to cool the containers. As the ice melts, the receptacle 165 at the bottom of the carton 160 serves to retain all or a portion of the water runoff from the melting ice. The receptacle 165 may also serve, for example, to house fine particulate matter that might otherwise escape through a glued seam. If one or more containers C is damaged during shipping or storage of the carton 160, the bottom receptacle 165 can serve to retain all or a portion of the contents of the broken container.

The blank 8 can, for example, be constructed of water resistant material to any degree desired so that liquid in the bottom of the carton 160 remains in the bottom receptacle 165 for a selected amount of time. The carton 160 can therefore be constructed so that liquid retained in the bottom receptacle 165 initially remains in the carton 160 at least until it reached the height $H_R$. Cartons according to the principles of the present invention may be formed from materials such as paperboard. Therefore, if exposed to water or other liquids for extended periods of time, the carton may allow for the passage of liquid through the wetted carton surfaces due to partial permeability of the carton material. In this specification, the term "liquid-tight" is generally used to define a section of a carton that is formed from a continuous section of material or of a section without any glued seams through which liquid or fine particulate matter might leak, and the term "liquid-tight" therefore encompasses cartons that may become partially water permeable over time due to prolonged exposure to water or other liquids.

In the above embodiments, the carton 160 is described as accommodating twelve 12-ounce cans containers C in 3×4×1 configuration. Other arrangements of containers, packages, articles, and other items, however, can be accommodated within a carton constructed according to the principles of the present invention. For example, a carton constructed according to the principles of the present invention would also work satisfactorily if the carton were sized and shaped to hold articles in other configurations, such as 4×3×1, 3×6×1, 2×4×1, 2×5×1, etc. The dimensions of the blank 8 may also be altered, for example, to accommodate various container forms. For example, 16-ounce petaloid bottles may be accommodated within a carton constructed according to the principles of the present invention.

In the exemplary embodiments discussed above, the blank may be formed from, for example, clay coated newsprint (CCN), solid unbleached sulfate board (SUS), and other materials. In general, the blank may be constructed from paperboard having a caliper of at least about 14, for example, so that it is heavier and more rigid than ordinary paper. The blank can also be constructed of other materials, such as cardboard, or any other material having properties suitable for enabling the carton to function at least generally as described above. The blank can be coated with, for example, a clay coating. The clay coating may then be printed over with product, advertising, and other information or images. The blank may then be coated with a varnish to protect information printed on the blanks. The blank may also be coated with, for example, a moisture barrier layer, on either or both sides of the blank. The blank can also be laminated to or coated with one or more sheet-like materials at selected panels or panel sections.

The term "line" as used herein includes not only straight lines, but also other types of lines such as curved, curvilinear or angularly displaced lines.

In accordance with the exemplary embodiment of the present invention, a fold line can be any substantially linear, although not necessarily straight, form of disruption or weakening in the blanks that facilitates folding therealong. More specifically, but not for the purpose of narrowing the scope of the present invention, examples of fold lines include: score lines; crease lines; a cut or a series of cuts that extend partially into and/or completely through the material along a desired line of weakness; and various sequential and/or overlapping combinations of these exemplary features.

For purposes of the description presented herein, the term "line of disruption" can be used to generally refer to cuts, scores, creases, cut-space lines, cut-creases, cut-scores, combinations thereof, and other forms of disruption formed in the material of the blanks. A "breachable" line of disruption is a line of disruption that is intended to be breached during ordinary use or packaging of the blanks. Examples of breachable lines of disruption include cut-creases, cut-scores, cut-spaces, scores, tear lines, combinations thereof, etc.

In the present specification, a "panel" or "flap" need not be flat or otherwise planar. A "panel" or "flap" can, for example, comprise a plurality of interconnected generally flat or planar sections. The above embodiments may be described as having one or panels adhered together by glue. The term "glue" is intended to encompass all manner of adhesives commonly used to secure paperboard carton panels in place.

In the illustrated embodiments, selected fold lines are shown as including spaced cuts to facilitate folding along the lines. If the cuts are below or adjacent to the bottom receptacle portion of the carton, less than 100% cuts may be used to prevent leakage along the fold lines. Alternatively, cuts or scores may be omitted within or near the receptacle portion.

It will be understood by those skilled in the art that while the present invention has been discussed above with reference to exemplary embodiments, various additions, modifications and changes can be made thereto without departing from the spirit and scope of the invention as set forth in the following claims.

What is claimed is:

1. A method of erecting a carton, comprising:

providing a carton blank having an upper side and an under side, the carton blank comprising:

a first side panel;

a bottom panel;

a second side panel foldably connected to the bottom panel at a transverse fold line;

a first top panel;

a second top panel foldably connected to the second side panel;

a first bottom end panel at a first end of the bottom panel;

a second bottom end panel at a second end of the bottom panel;

at least one first top flap foldably connected to a first end of the second top panel at a first longitudinal fold line; and at least one second top flap foldably connected to a second end of the second top panel at a second longitudinal fold line;

folding the second side panel with respect to the bottom panel about the transverse fold line;

after folding the second side panel about the transverse fold line, folding the at least one first top flap about the first longitudinal fold line so that a print side of the at least one first top flap contacts a print side of the second top panel; and folding the at least one second top flap about the second longitudinal fold line.

2. The method of claim 1, further comprising, after folding the at least one first top flap about the first longitudinal fold line:

gluing the blank so that it forms a tubular structure; and forming a top panel at least from the first top panel, the second top panel, the at least one first top flap, and the at least one second top flap.

3. The method of claim 2, wherein the at least one first top flap comprises a pair of first top flaps connected at an oblique fold line, the method further comprising folding the pair of first top flaps at the oblique fold line.

4. The method of claim 3, wherein the at least one second top flap comprises a pair of second top flaps connected at an oblique fold line, the method further comprising folding the pair of second top flaps at the oblique fold line.

5. The method of claim 3, wherein gluing the blank so that it forms a tubular structure comprises:

folding the first top panel with respect to the first side panel about a transverse fold line.

6. The method of claim 5, wherein gluing the blank so that it forms a tubular structure comprises:

adhering the first top panel to the at least one first top flap and the at least one second top flap.

7. The method of claim 6. wherein the blank further comprises a first top end flap foldably connected to the at least one first top flap and a second top end flap foldably connected to the at least one second top flap, wherein gluing the blank so that it forms a tubular structure further comprises:

adhering the first top panel to the first top end flap and to the second top end flap.

8. The method of claim 2, after gluing the blank so that it forms a tubular structure:

at least partially closing a first end of the tubular structure; and at least partially closing a second end of the tubular structure.

9. The method of claim 8, wherein at least partially closing the first end of the tubular structure comprises folding the first bottom end panel with respect to the bottom panel about the first longitudinal fold line.

10. The method of claim 9, wherein a first pair of gusset panels connects a first side of the first bottom end panel to the first side panel and a second pair of gusset panels connects a second side of the first bottom end panel to the second side panel, wherein folding the first bottom end panel about the first longitudinal fold line causes the first and second gusset panel pairs to fold inwardly.

11. The method of claim 1, wherein the blank further comprises:

at least one third top flap foldably connected to a first end of the first top panel at the first longitudinal fold line; and at least one fourth top flap foldably connected to a second end of the first top panel at the second longitudinal fold line.

12. The method of claim 11, further comprising:

folding the at least one third top flap about the first longitudinal fold line;

folding the at least one fourth top flap about the second longitudinal fold line;

adhering the at least one third top flap to the at least one first top flap; and adhering the at least one fourth top flap to the at least second top flap.

13. The method of claim 1 wherein the upper side of the blank is for forming an exterior surface of the carton and the under side of the blank is for forming an interior surface of the blank, the print side of the at least one first top flap and the print side of the second top panel both comprise at least a portion of the upper side of the blank.

14. The method of claim 13 wherein the at least one first top flap comprises two first top flaps connected at an oblique fold line, the method further comprising folding one of the two first top flaps at the oblique fold line so that the two first top flaps are in face-to-face contact.

15. The method of claim 14 wherein the at least one second top flap comprises two second top flaps connected at an oblique fold line, the method further comprises folding one of the two second top flaps at the oblique fold line so that the two second top flaps are in face-to-face contact.

16. The method of claim 1 wherein:

the transverse fold line is a second transverse fold line;

the first side panel is foldably connected to the bottom panel at a first transverse fold line;

the first top panel is foldably connected to the first side panel;

the method further comprises, after folding the second top flap about the second longitudinal fold line, folding the first top panel about a third transverse fold line connecting the first top panel to the first side panel.

17. The method of claim 16, wherein the blank further comprises:

at least one third top flap foldably connected to a first end of the first top panel at the first longitudinal fold line; and at least one fourth top flap foldably connected to a second end of the first top panel at the second longitudinal fold line.

18. The method of claim 17, further comprising:

after folding the first top panel about the transverse fold line connecting the first top panel to the first side panel, folding the at least one third top flap about the first longitudinal fold line so that a print side of the at least one third top flap contacts a print side of the first top panel and folding the at least one fourth top flap about the second longitudinal fold line so that a print side of the at least one fourth top flap contacts a print side of the first top panel.

19. The method of claim 18, further comprising:

adhering the at least one third top flap to the at least one first top flap; and adhering the at least one fourth top flap to the at least one second top flap.

20. The method of claim 16, further comprising, after folding the at least one first top flap about the first longitudinal fold line:

gluing the blank; and forming a top panel at least from the first top panel, the second top panel, the at least one first top flap, and the at least one second top flap.

21. The method of claim 20, wherein the at least one first top flap comprises a pair of top flaps connected at an oblique fold line, the method further comprising folding the pair of top flaps at the oblique fold line after folding the at least one first top flap about the first longitudinal fold line.

22. The method of claim 16, further comprising:

gluing the blank so that it forms a tubular structure;

at least partially closing a first end of the tubular structure; and at least partially closing a second end of the tubular structure.

23. The method of claim 16, wherein a first pair of gusset panels connects a first side of the first bottom end panel to the first side panel and a second pair of gusset panels connects a second side of the first bottom end panel to the second side panel, wherein folding the first bottom end panel about the first longitudinal fold line causes the first and second gusset panel pairs to fold inwardly.

* * * * *